US006684793B2

(12) United States Patent
Dutoit

(10) Patent No.: US 6,684,793 B2
(45) Date of Patent: Feb. 3, 2004

(54) VIADUCT FOR A RAILWAY LINE OR THE LIKE

(75) Inventor: Daniel Dutoit, Boulogne Billancourt (FR)

(73) Assignee: Systra, Paris (FR)

( * ) Notice: Subject to any disclaimer, the term of this patent is extended or adjusted under 35 U.S.C. 154(b) by 0 days.

(21) Appl. No.: 10/124,221

(22) Filed: Apr. 16, 2002

(65) Prior Publication Data

US 2002/0162479 A1 Nov. 7, 2002

(30) Foreign Application Priority Data

Apr. 17, 2001 (FR) ..... 01 05215

(51) Int. Cl.[7] ..... B61B 1/00
(52) U.S. Cl. ..... 104/124; 104/28
(58) Field of Search ..... 104/124, 125, 104/126, 27, 28

(56) References Cited

U.S. PATENT DOCUMENTS

| | | | | |
|---|---|---|---|---|
| 2,226,432 A | * | 12/1940 | Heinze | 104/124 |
| 3,859,682 A | * | 1/1975 | Sulkiewicz | 104/124 |
| 4,142,468 A | | 3/1979 | Birnstiel | |
| 4,313,383 A | * | 2/1982 | Parazader | 104/124 |
| 5,119,731 A | | 6/1992 | Muller | |
| 5,231,931 A | * | 8/1993 | Sauvageot | 104/124 |
| 5,386,782 A | * | 2/1995 | Dinis et al. | 104/124 |

* cited by examiner

*Primary Examiner*—S. Joseph Morano
*Assistant Examiner*—Lars A. Olson
(74) *Attorney, Agent, or Firm*—Harness, Dickey & Pierce, P.L.C.

(57) ABSTRACT

Beams extend transversely outwards from at least one side of each span beyond the corresponding side flange and shelf. Each beam is of a length in the transverse direction and of strength that are predetermined to be sufficient for enabling additional structures, e.g. slabs, to be installed subsequently on said beams, which additional structures preferably extend said soleplates outwards, in particular to form a station.

9 Claims, 4 Drawing Sheets

VIADUCT FOR A RAILWAY LINE OR THE LIKE

The present invention relates to a viaduct for a railway line or the like, and comprising successive spans resting on supports such as piers.

BACKGROUND OF THE INVENTION

U.S. Pat. No. 4,142,468 discloses a viaduct of the above-specified type in which each span is substantially U-shaped in cross-section.

This U-shaped section corresponds to a load-carrying slab forming the web of the U-shape and connected on either side to respective upwardly extending flanges.

Each flange is surmounted on top by a substantially horizontal soleplate forming a shelf that extends transversely, at least towards the opposite flange.

After such a viaduct has been built, it can become necessary to build additional structures, for example a new station comprising, on one side at least, a slab forming a platform for passengers.

Such new structures require major work in order to establish new supports standing on the ground, one or more slabs, and superstructures that are provided in conventional manner in such stations.

OBJECT AND SUMMARY OF THE INVENTION

The object of the present invention is to remedy the drawbacks of known viaducts and to propose a viaduct of the above-specified type adapted to make it very easy and quick to build new superstructures on at least one side of the viaduct without impeding use of the line.

According to the invention, in the viaduct of the above-specified type, for at least some of its spans it includes beams extending transversely outwards from at least one side of said spans beyond the corresponding side flange and shelf, each beam being of length in the transverse direction and of strength that are predetermined to be sufficient to enable additional structures to be built subsequently on said beams, e.g. slabs which preferably extend said soleplates outwards.

Thus, these transverse beams made when the viaduct is initially built make it possible at a later date, without any lead time, to build additional structures suitable for fixing on such transverse beams, and to do so in any conventional known manner.

Thus, using the transverse beams for support, it is possible to erect any kind of additional structure, whether temporary or permanent, e.g. a new station with platforms, and superstructures, without there being any need to dig the ground and install new foundations or to mount bulky scaffolding in order to build such new structures.

BRIEF DESCRIPTION OF THE DRAWINGS

Other features and advantages of the present invention appear from the following detailed description.

In the accompanying drawings, given purely by way of non-limiting example.

MORE DETAILED DESCRIPTION

Figure 2:
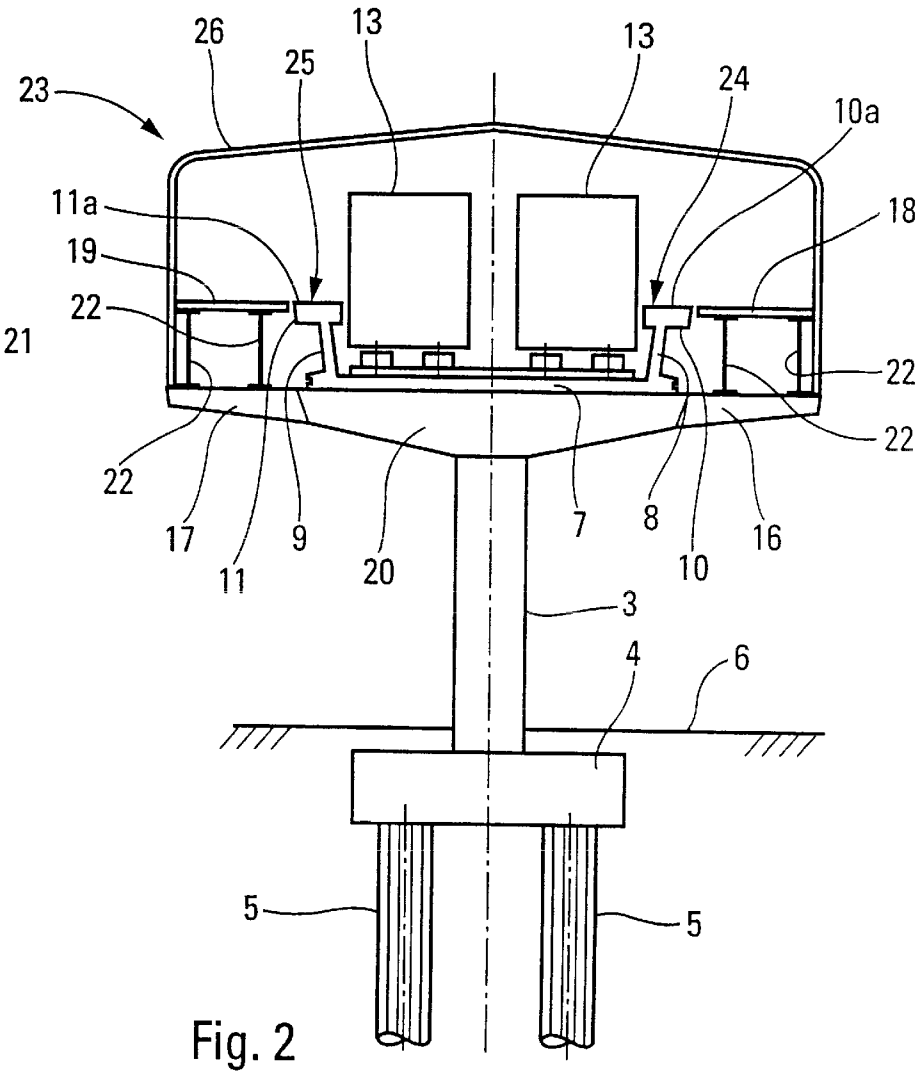
FIG. 2 is a diagrammatic view similar to FIG. 1 showing platforms and superstructures for a new station.
Figure 1:
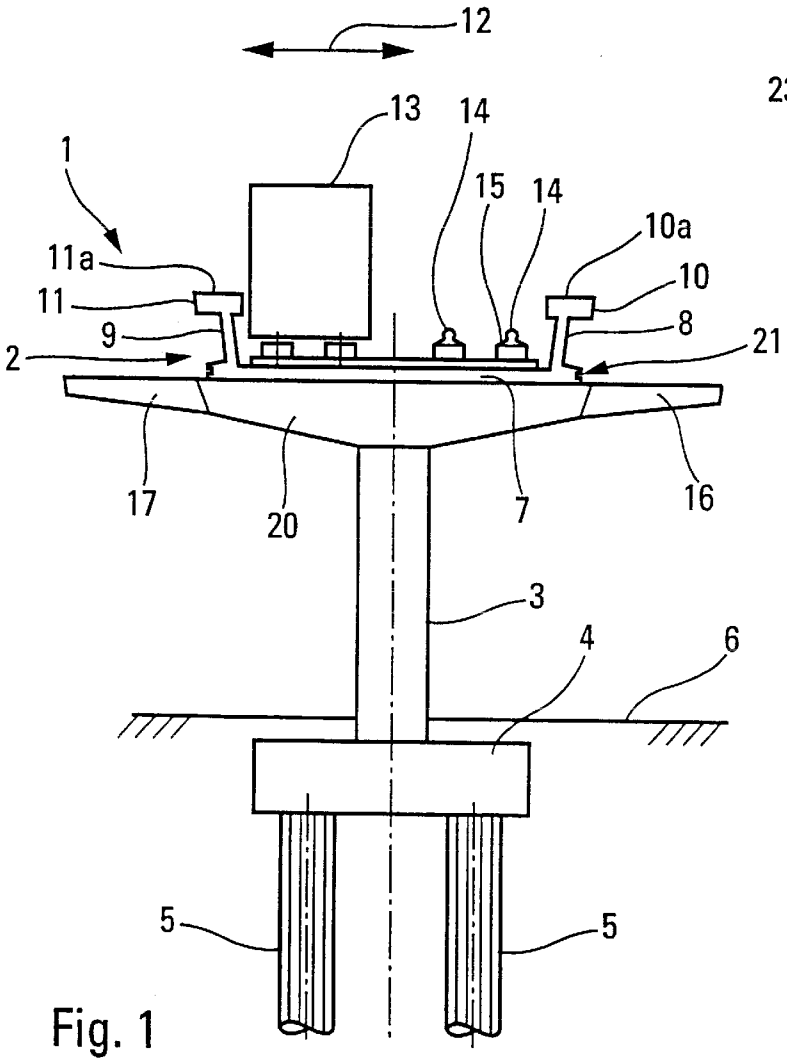
FIG. 1 is a diagrammatic cross-section view through an embodiment of a viaduct in accordance with the present invention.

In the embodiment of FIGS. 1 and 2, the viaduct 1 for a railway or other line comprises successive spans 2 resting on supports such as piers 3 themselves built on foundations 4 e.g. standing on piles 5 engaged in conventional manner in the ground.

In cross-section, each span 2 is substantially U-shaped, comprising a load-carrying slab 7 forming the web of the U-shape and connected on at least one side, and on both sides in the figures, to a respective upwardly-extending side flange 8, 9.

The top of each flange 8, 9 is surmounted by a substantially horizontal corresponding soleplate 10, 11 forming a shelf which extends transversely in the direction of arrow 12, at least towards the opposite flange 9, 8.

As shown diagrammatically, the top surface 10*a*, 11*a* of each soleplate 10, 11 is situated at a level that is substantially equal to the level of the floor of a transport vehicle 13 traveling on the railway or other line carried by the viaduct 1.

In the example shown, the vehicles 13 run on rails 14, themselves laid on conventional supports 15 of known type, e.g. transverse or longitudinal sleepers (ties).

Naturally, the vehicles 13 can be mounted on wheels fitted with pneumatic tires, in a manner that is known per se and need not be described herein (see below).

In the example shown, at least some of the spans 2 of the viaduct 1 include transverse beams 16, 17 projecting outwards transversely in the direction of arrow 12 on either side of each span 2 beyond the corresponding side flanges 8, 9 and shelves 10, 11.

In the transverse direction of arrow 12, each beam 16, 17 is of predetermined length and strength that are sufficient to enable additional structures to be installed subsequently on said beams 16, 17, e.g. slabs 18, 19 which preferably extend said soleplate 10, 11 outwards.

In the embodiment of FIGS. 1 and 2, the transverse beams 16, 17 are secured to joists or "trimmers" 20 placed on top of the piers 3 and supporting the deck 21 of each span 2.

This is advantageous and enables spans 2 to be built that are identical and fully prefabricated or that are made up of identical prefabricated arch members, with only certain piers carrying joists 20 fitted with transverse beams 16, 17 of the invention at locations that are decided in advance.

Naturally, the beams 16, 17 can be replaced by slabs of length in the longitudinal direction of the viaduct matching the length of said joists 20.

In the diagrammatic example of FIG. 2, longitudinal beams shown diagrammatically at 22 are placed on the joists 20 of two adjacent piers and support the slabs 18 and 19 which extend the soleplates 10 and 11.

As shown diagrammatically in FIG. 2, it is thus possible to build a station 23 having a platform-forming shelf 24, 25 on either side. Each platform 24, 25 has a front platform portion constituted by the correspond soleplate 10, 11, and a rear platform portion constituted by the corresponding slab 18, 19 adjacent to said soleplate and at the same level.

In conventional manner, the station also has a roof-forming superstructure shown diagrammatically at 26, which superstructure is supported, like the slabs 18 and 19, by the transverse beams 16, 17, and all of these elements can be built or installed without interrupting operation of the transportation line.

Thereafter, it suffices to install conventional means for moving passengers in both directions beneath ground level 6 and the slabs 18, 19 and also, where appropriate, to install any such premises, offices, etc. as may be required for housing station staff and users of the line.

Figure 3:
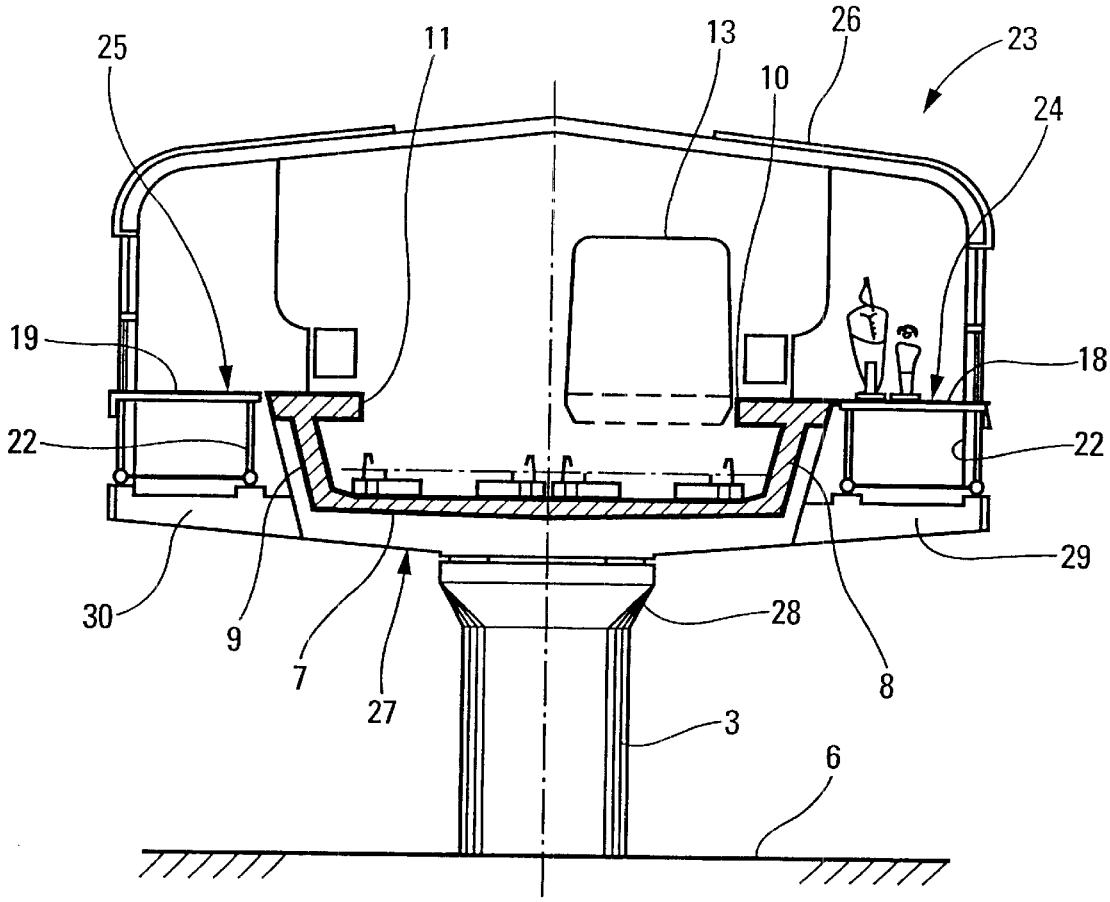
FIG. 3 is a view similar to FIG. 2 showing another embodiment of a viaduct of the present invention.

In the embodiment of FIG. 3, the deck 27 rests directly on the capital 28 formed at the top of each pier 3.

The transverse beams 29, 30 are secured to the deck 27 and are situated substantially at the same level as the load-carrying slab 7.

It is quite possible to choose to fit the deck 27 of each span with transverse beams 29, 30. It is also possible, in a variant, to provide transverse beams 29, 30 only for those spans that might subsequently receive an additional structure such as a station.

Figure 4:
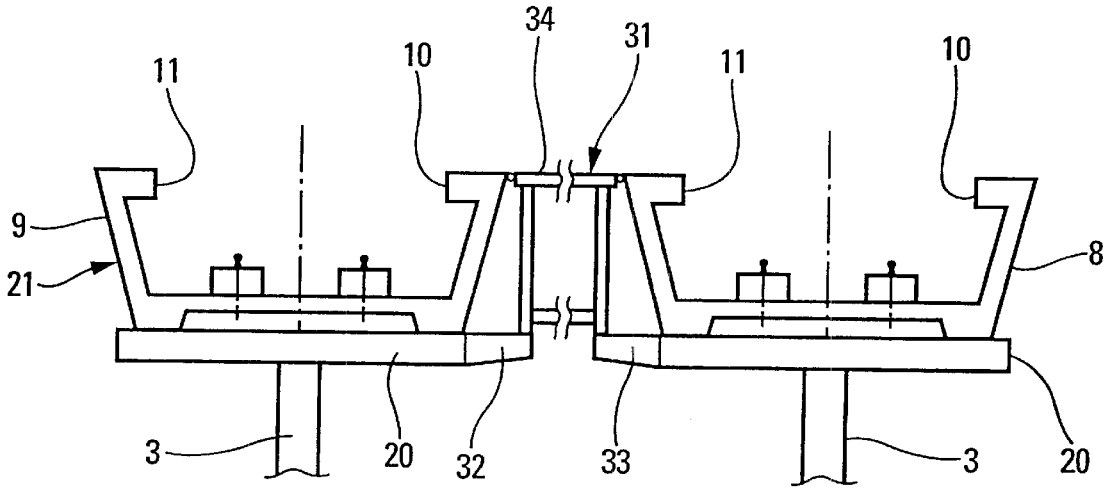
FIG. 4 is a section view through another embodiment of a viaduct of the present invention.

In the embodiment of FIG. 4, there can be seen two parallel viaducts each carrying a single track. It is then possible to envisage installing a central platform only, as shown diagrammatically at 31 and of arbitrary width, depending on requirements.

To this end, transverse beams 32, 33 are provided on one side only of the corresponding deck and they extend transversely towards the other deck. Thus, the slab 34 which may be constituted by a single piece or built up using a plurality of individual slabs, is placed between the two adjacent soleplates 10, 11 of the two adjacent viaducts, and the structure formed by the beam 22 supporting the slab 34 is fixed to the transverse beams 32, 33.

It is also possible to provide a roof-forming superstructure bearing on the transverse beams 32, 33, either directly or else via the slab 34.

Figure 5:
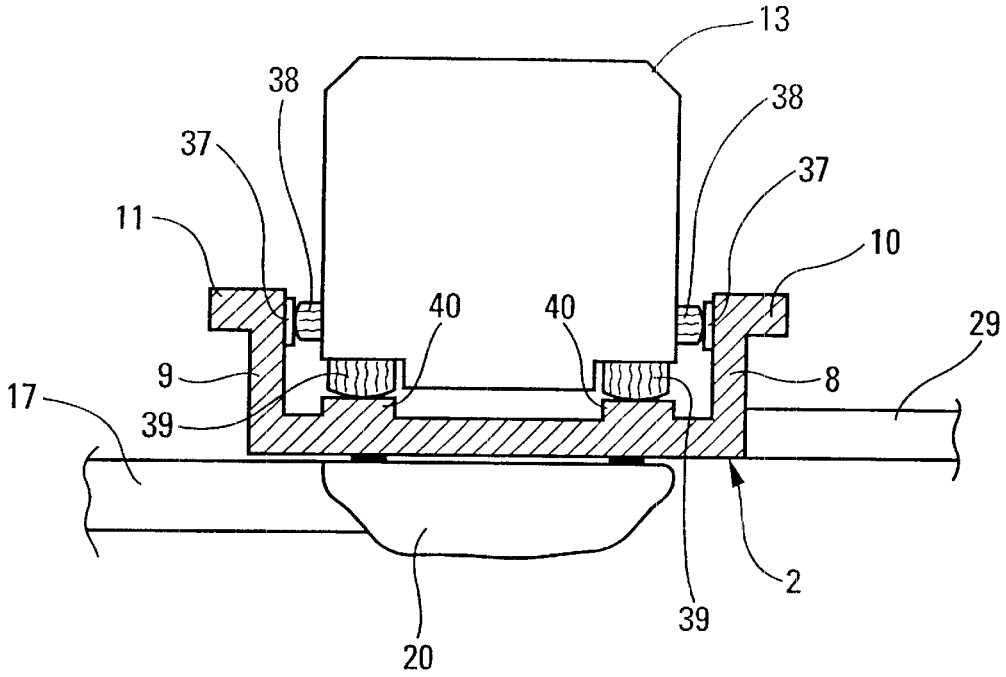
FIG. 5 is a diagrammatic section view through another embodiment of a viaduct of the present invention.

FIG. 5 shows a single track viaduct receiving a vehicle that is mounted on wheels fitted with pneumatic tires.

This viaduct can be fitted equally well with transverse beams such as 17 secured to joists 20 or transverse beams such as 29 secured to spans 2 or arch members constituting said spans.

Each flange 8, 9 has a shape 37 on its bottom wall facing towards the other flange, which shape forms a substantially vertical guide serving as a runner and bearing surface for guide wheels 38 on the vehicle 13.

The vehicle 13 is itself mounted on tires 39 running on longitudinally extending sills referenced 40.

It would also be possible to provide rails (not shown) suitable for supporting conventional flanged railway wheels in the event of a tire puncturing (not shown).

Figure 6:
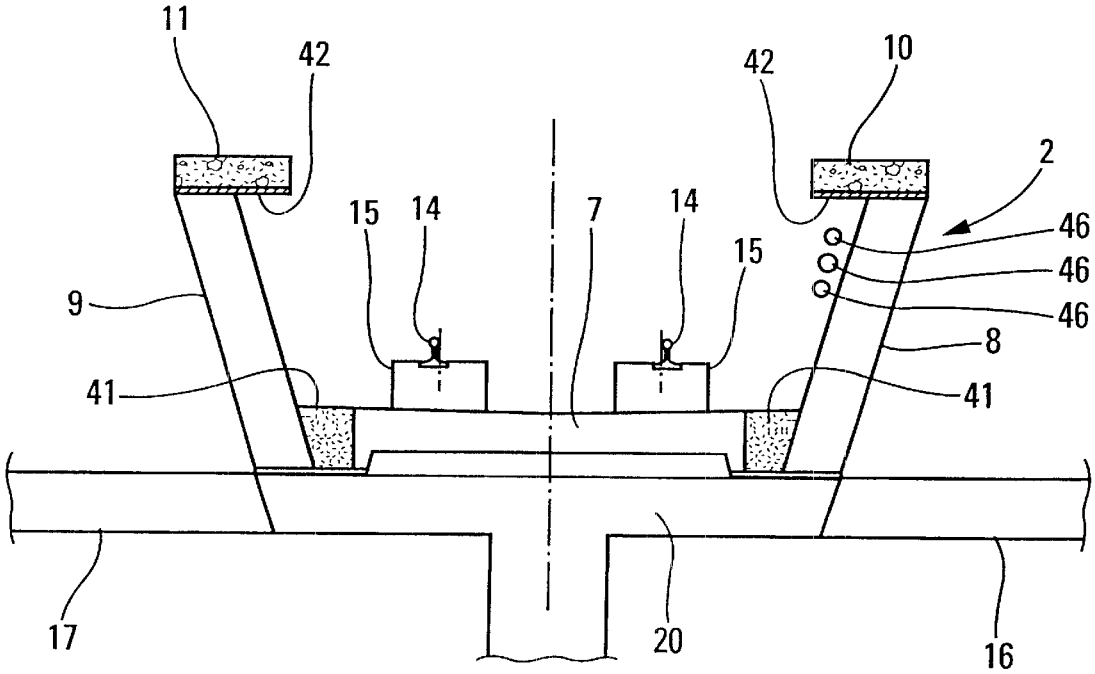
FIG. 6 is a view similar to FIG. 5 showing another embodiment of the present invention.

In the embodiment of FIG. 6, the span 2 which is mounted joists 20 has a load-carrying slab 7 with metal flanges 8, 9 connected thereto, the web being connected in any known manner to the slab 7 together with filler concrete 41 that is put into place on site.

In this case, the soleplates 10 and 11 are themselves supported by metal sheet 42.

Figure 7:
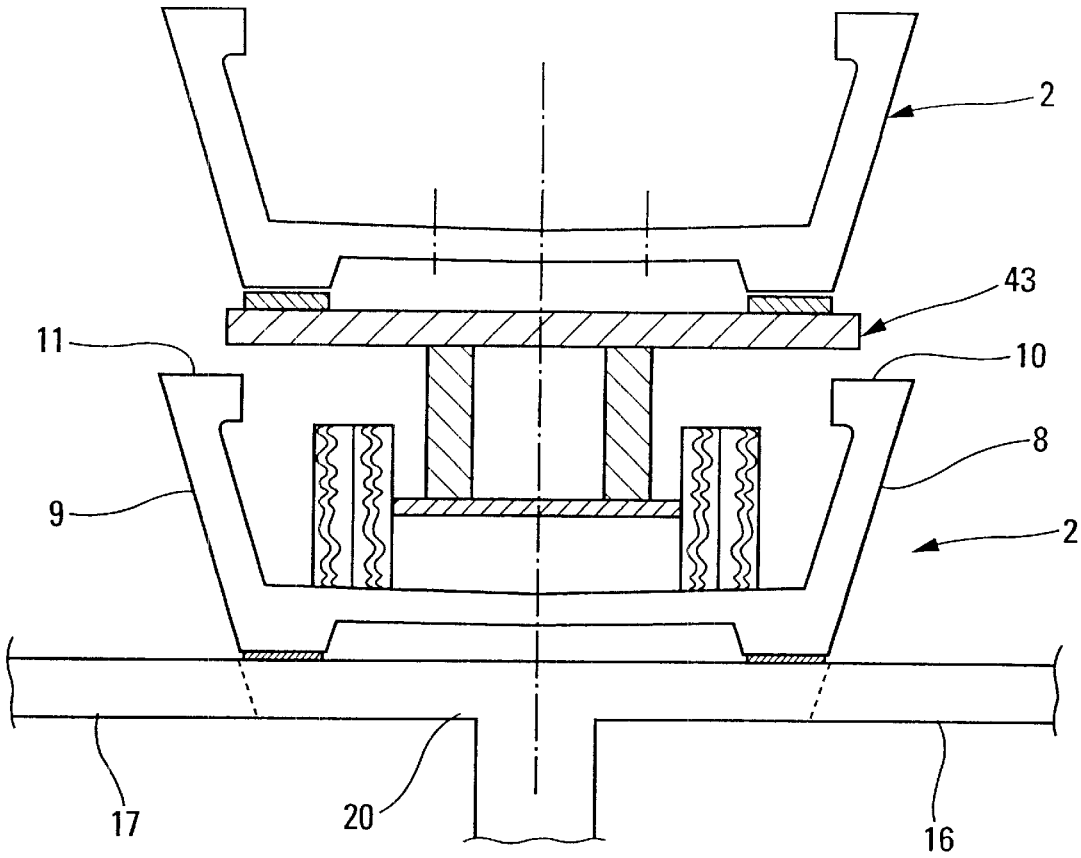
FIG. 7 is a view similar to FIG. 5 showing another embodiment of the present invention.

In the embodiment of FIG. 7, corresponding particularly to building the viaduct by means of fully prefabricated spans carried by joists 20, each new span can be brought to its site for installation by a transport vehicle, referenced 43, adapted to travel along the load-carrying slab 7 of spans that are already in place. Such a vehicle can naturally be fitted with pneumatic tires, as shown in the figure, prior to laying the railway tracks, or it can be provided with flanged wheels and run along the railway track that has already been put into place.

Figure 8:
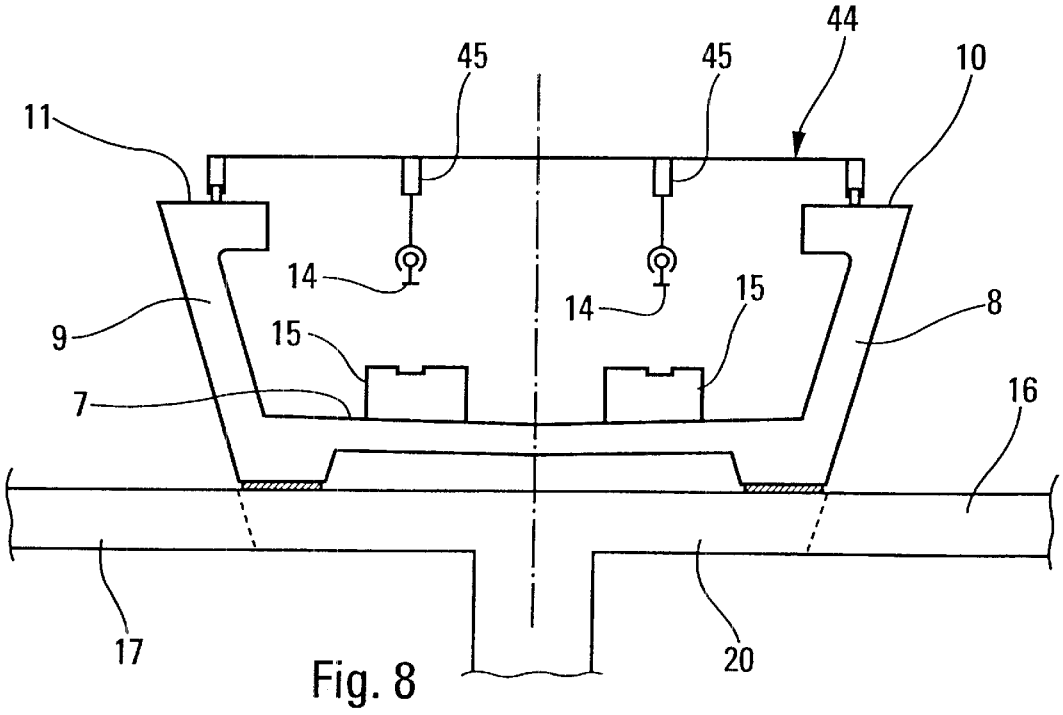
FIG. 8 is a view similar to FIG. 5 showing another embodiment of the present invention.

In the embodiment of FIG. 8, which corresponds to a single track viaduct in this example, a gantry 44 suitable for running on the soleplates 10, 11 and provided with hoists shown diagrammatically at 45 serves to transport, lay, and adjust rails 14 on the sleepers 15.

A viaduct has thus been described which is provided with transverse beams that project outwardly, said beams being placed either along the entire length of the viaduct, or else only at particular locations specified in advance.

Such beams make it possible subsequently to build a new station or to extend an existing station quickly, easily, and at reduced cost.

When the transverse beams 16, 17 are secured to joists 20, the platforms of new stations are independent of the deck of each span, thus making it simpler both to design each span and to design each platform, in particular concerning vibration, bracing, etc.

Naturally, all kinds of electric cable suitable for use in operating the line can be placed beneath the soleplates 10, 11 as represented by reference 46 in FIG. 6.

The flanges 8, 9 and the soleplates 10, 11 are preferably designed in such a manner as to be capable of holding a train or a vehicle that has derailed or that has escaped from the guide means provided.

The station shown in FIGS. 2 and 3 which rest directly on the beams 16, 17 or 29, 30 has minimum visual impact in the surroundings given that its own outline is not added to that of the viaduct and the vehicles, but on the contrary replaces said outline.

Finally, the flanges 8, 9 serve in conventional manner as screens against noise.

Naturally, the present invention is not limited to the embodiments described above and numerous changes and modifications can be made thereto without going beyond the ambit of the invention.

Naturally, one-piece arch members or spans that are prefabricated prior to being installed can be made of pre-stressed concrete. The same applies to all of the other prefabricated elements used in the context of the present invention.

What is claimed is:

1. A viaduct for a railway line, comprising a deck formed by successive spans resting on supports or as piers, each span having a substantially U-shaped cross-section comprising a load-carrying slab forming the web of the U-shape and connected on either side to an upwardly-extending side flange, the top portion of each flange being surmounted by a substantially horizontal shelf-forming soleplate extending transversely at least towards the opposite flange, the top surface of each soleplate being situated substantially the same level as the floor of a transport vehicle, so that said soleplate is adapted to constitute a front platform portion of a platform-forming shelf of a railway station.

2. A viaduct according to claim 1, wherein, for at least some of its span, it includes beams extending transversely outwards from at least one side of said spans beyond the corresponding side flange and shelf, each beam being of length in the transverse direction and of strength that are predetermined to be sufficient to enable additional structures to be built subsequently on said beams.

3. A viaduct according to claim 2, wherein said beams extend outwards from said soleplates.

4. A viaduct according to claim 2, wherein said additional structures to be built comprise said platform-forming shelf of said railway station.

5. A viaduct according to claim 2, wherein said beams are secured to the deck and are situated at substantially the same level as the load-carrying slab.

6. A viaduct according to claim 2, wherein said beams are secured to joists supporting the deck at the location of each pier or support.

7. A viaduct according to claim 2, wherein it has at least one station comprising at least one platform-forming shelf made up of a front platform portion constituted by the corresponding soleplate and of slabs forming a rear platform portion adjacent to the front platform portion and placed on a structure which is fixed to the transverse beams in such a manner that the slabs forming the rear platform portions are at substantially the same level as the corresponding soleplate.

8. A viaduct according to claim 7, wherein the slab forming a portion of the platform is placed between two adjacent soleplates of two adjacent viaducts and the structure supporting the slab is fixed to transverse beams of the two adjacent viaducts so that the shelf constitutes a central platform common to both viaduct.

9. A viaduct according to claim 7, including a roof-forming superstructure supported on the transverse beams.

* * * * *